US007588297B1

(12) United States Patent
Picard

(10) Patent No.: US 7,588,297 B1
(45) Date of Patent: Sep. 15, 2009

(54) SHAPED FABRIC CHAIR DIAPHRAGM AND METHOD OF FORMING SAME

(75) Inventor: Ronald E. Picard, Watertown, CT (US)

(73) Assignee: Franklin Products, Inc., Torrington, CT (US)

( * ) Notice: Subject to any disclaimer, the term of this patent is extended or adjusted under 35 U.S.C. 154(b) by 0 days.

(21) Appl. No.: 12/042,462

(22) Filed: Mar. 5, 2008

(51) Int. Cl.
*A47C 7/02* (2006.01)

(52) U.S. Cl. ..... 297/452.56

(58) Field of Classification Search ..... 297/452.56, 297/452.63, 440.11; 5/652
See application file for complete search history.

(56) References Cited

U.S. PATENT DOCUMENTS

| | | | | |
|---|---|---|---|---|
| 4,965,899 | A | 10/1990 | Sekido et al. | |
| 5,000,515 | A | 3/1991 | Deview | |
| 5,393,126 | A * | 2/1995 | Boulva | 297/452.56 |
| 5,490,295 | A * | 2/1996 | Boyd | 5/687 |
| 5,713,631 | A * | 2/1998 | O'Neill et al. | 297/284.6 |
| 5,787,562 | A | 8/1998 | Penley | |
| 6,082,825 | A | 7/2000 | Simon | |
| 6,398,310 | B1 | 6/2002 | Seeliger | |
| 6,604,792 | B1 | 8/2003 | Picard | |
| 6,702,389 | B2 | 3/2004 | Hall, Jr. et al. | |
| 6,722,742 | B2 | 4/2004 | Potes et al. | |
| 2003/0001424 | A1 | 1/2003 | Mundell et al. | |
| 2003/0085607 | A1 * | 5/2003 | Jones et al. | 297/452.56 |
| 2004/0245841 | A1 | 12/2004 | Peterson et al. | |

* cited by examiner

*Primary Examiner*—Milton Nelson, Jr.
(74) *Attorney, Agent, or Firm*—McCormick, Paulding & Huber LLP

(57) ABSTRACT

A support diaphragm for a seat or backrest of a chair includes a support frame having laterally spaced first and second support portions. A support material includes a flexible sheet extending from and generally tensioned between the support portions to form a front portion, and extending from and generally tensioned between the support portions to form a back portion spaced from and in underlying relationship to the front portion. A strut is coupled at lateral ends to the front and back portions of the support material. The strut lengthwise extends along the support material in at least one predetermined direction relative to a direction of tension in the support material. The strut provides generally no resistance to movement of the front and back portions toward each other, the width of the strut between the lateral ends provides a desired amount of contouring of the front portion of the support material.

4 Claims, 2 Drawing Sheets

SHAPED FABRIC CHAIR DIAPHRAGM AND METHOD OF FORMING SAME

FIELD OF THE INVENTION

This invention relates generally to a fabric diaphragm for a chair seat and backrest, and more particularly to the construction and method of applying fabric on a chair frame.

BACKGROUND OF THE INVENTION

Fabric diaphragms for seat and backrest of a cushioned chair used in, for example, airplanes are typically stretched between or around two tubes so as to create a flexible surface on which a cushion may be placed and the passenger is seated. The diaphragm is stretched flat across (or front to back). In cases where the tubes are straight, the fabric also will be stretched straight. In cases where the frame is contoured, the diaphragm will follow the contours of the frame, but will still be stretched straight across. Stretching the diaphragm to form a generally flat, non-contoured surface does not provide an optimally comfortable surface upon which to sit for a prolonged duration.

It is therefore an object of the present invention to provide a shaped fabric diaphragm for the seat and backrest of a chair which overcomes the drawbacks of prior fabric diaphragms.

SUMMARY OF THE INVENTION

In an aspect of the present invention, a support diaphragm for a seat or backrest of a chair includes a support frame having laterally spaced first and second support portions. A support material includes a flexible sheet extending from and generally tensioned between the first support portion and the second support portion to form a front portion, and extending from and generally tensioned between the first support portion and the second support portion to form a back portion spaced from and in underlying relationship to the front portion. A strut is coupled at a first lateral end to the front portion of the support material and coupled at a second lateral end to the back portion of the support material. The strut lengthwise extends along the support material in at least one predetermined direction relative to a direction of tension in the support material. The strut is configured to provide generally no resistance to movement of the front portion and the back portion toward each other when pressure is applied to the front portion, and a width of the strut between the first lateral end and the second lateral end provides a desired amount of contouring of the front portion of the support material.

In a second aspect of the present invention, a method of forming a support diaphragm for a chair seat or backrest includes extending and generally tensioning a flexible sheet of support material between laterally spaced first and second support portions of a support frame to form a front portion. The flexible sheet of support material is extended to and generally tensioned between the laterally spaced first and second support portions of the support frame to form a back portion spaced from and in underlying relationship to the front portion. A strut is coupled at a first lateral end to the front portion of the support material and is coupled at a second lateral end to the back portion of the support material such that the strut lengthwise extends along the support material in at least one predetermined direction relative to a direction of tension in the support material. The strut is configured to provide generally no resistance to movement of the front portion and the back portion toward each other when pressure is applied to the front portion, and a width of the strut between the first lateral end and the second lateral end is configured to provide a desired amount of contouring of the front portion of the support material.

In a third aspect of the present invention, a support diaphragm for a backrest of a chair includes a support frame including laterally spaced first and second support portions. A support material includes a flexible sheet extending from and generally tensioned between the first support portion and the second support portion to form a front portion, and extending from and generally tensioned between the first support portion and the second support portion to form a back portion spaced from and in underlying relationship to the front portion. The front portion is configured as a backrest including a lumbar area fabricated from a generally non-stretchable material and a remaining area of the front portion fabricated from a generally stretchable material. A strut is coupled at a first lateral end to the front portion of the support material and coupled at a second lateral end to the back portion of the support material. The strut lengthwise extends along the support material in at least one predetermined direction relative to a direction of tension in the support material. The strut is configured to provide generally no resistance to movement of the front portion and the back portion toward each other when pressure is applied to the front portion. A width of the strut between the first lateral end and the second lateral end is configured to provide a desired amount of contouring of the front portion of the support material.

In a fourth aspect of the present invention, a support diaphragm for a seat or backrest of a chair includes a support frame including laterally spaced first and second support portions. A support material includes a flexible sheet extending from and generally tensioned between the first support portion and the second support portion to form a front portion, and extending from and generally tensioned between the first support portion and the second support portion to form a back portion spaced from and in underlying relationship to the front portion. At least a portion of the front portion is fabricated from a generally stretchable material, and the back portion is fabricated from a generally non-stretchable material. A strut is coupled at a first lateral end to the front portion of the support material and coupled at a second lateral end to the back portion of the support material. The strut lengthwise extends along the support material in at least one predetermined direction relative to a direction of tension in the support material. The strut is configured to provide generally no resistance to movement of the front portion and the back portion toward each other when pressure is applied to the front portion. A width of the strut between the first lateral end and the second lateral end is configured to provide a desired amount of contouring of the front portion of the support material.

DETAILED DESCRIPTION OF THE PREFERRED EMBODIMENTS

Figure 1:
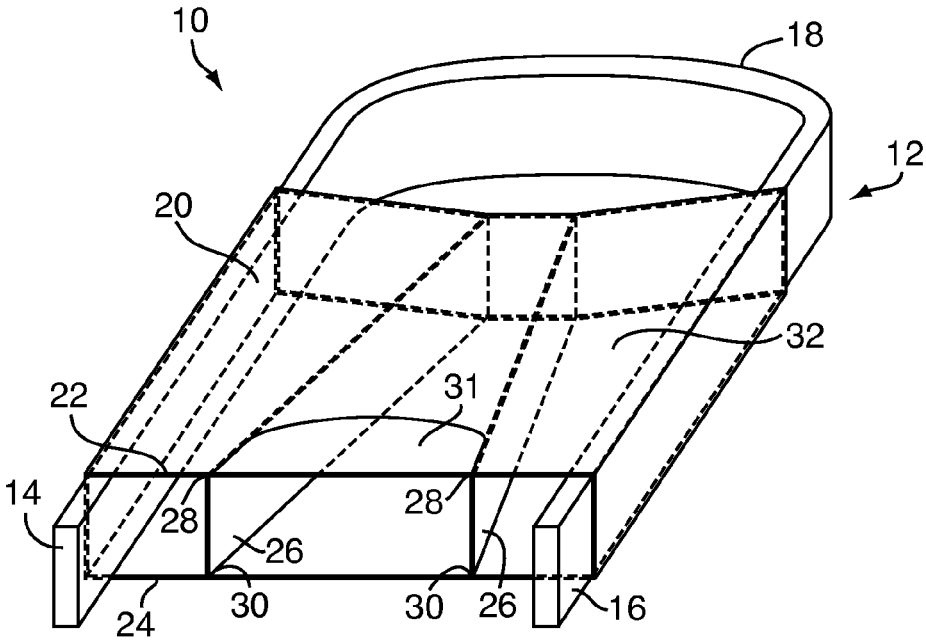
FIG. 1 is a perspective view of a support diaphragm for a chair seat or backrest embodying the present invention.

With reference to FIG. 1, a support diaphragm for a chair seat or backrest embodying the present invention is generally indicated by the reference number 10. The support diaphragm 10 comprises a generally rigid support frame 12 including laterally spaced first and second support portions 14, 16. As shown in FIG. 1, The support frame 12 includes a central portion 18 coupled at longitudinal ends to the first and second support portions 14, 16 to form a generally U-shaped support frame, but may take other practical shapes.

The support diaphragm 10 further comprises a support material 20 including a flexible sheet extending from and generally tensioned between the first support portion 14 and the second support portion 16 to form a front portion 22. The flexible sheet of support material 20 further extends from and is generally tensioned between the first support portion 14 and the second support portion 16 to form a back portion 24 spaced from and in underlying relationship to the front portion 22. More specifically, the front portion 22 of the support material 20 preferably is generally tensioned around one or both of the first and second support portions 14, 16 and extends to the other support portion to form the back portion 24. When tensioned around the support portions 14, 16, the front portion 22 and the back portion 24 are formed from a continuous flexible sheet of the support material 20.

The support diaphragm 10 further comprises at least one strut 26 coupled at a first lateral end 28 to the front portion 22 of the support material 20, and coupled at a second lateral end 30 to the back portion 24 of the support material 20. In an exemplary embodiment the strut 26 is sewn to the support material 20, but may be coupled to the support material by other practical means without departing from the scope of the present invention. The strut 26 lengthwise extends along the support material 20 in at least one predetermined direction relative to a direction of tension or in which the support material is being stretched onto the support portions 14, 16. More specifically, the strut 26 can lengthwise be straight, curved, forming angles, or have lengthwise portions that are a combination of shapes such as straight, curved or forming angles from one lengthwise end to the other. Moreover, the strut 26 can lengthwise extend in any direction relative to the direction of tension in the support material 20. In other words, the strut 26 can lengthwise extend in a direction having an angle ranging from that of parallel to perpendicular to the direction of tension in the support material 20. The strut 26 is configured to provide generally no resistance to movement of the front portion 22 and the back portion 24 toward each other when pressure is applied to the front portion. Although two struts 26 are shown in FIG. 1, it should be understood that any number of struts having the same or different lengths, widths, lengthwise direction, and material construction relative to each other can be employed without departing from the scope of the present invention.

A width of the strut 26 between the first lateral end 28 and the second lateral end 30 is configured to provide three-dimensional shape to the diaphragm, or more specifically to provide a desired amount of contouring of the front portion 22 of the support material 20 by pulling the front portion 22 and the back portion 24 toward each other relative to the spacing between the front portion and the back portion without the strut. The width of the strut 26 can be non-uniform along the lengthwise direction to provide variable amounts of contouring along different portions of the front portion 22 of the support material 20. The width of the strut 26 when relatively short pulls the front portion 22 and the back portion 24 closer together than when the width of the strut is relatively long. Moreover, the width of the strut 26 can be chosen at locations to be long enough to provide no localized contouring of the front portion 22.

As shown in FIG. 1, for example, the width of the strut 26 progressively tapers along the lengthwise direction to provide the variable amounts of contouring along different portions of the front portion 22 of the support material 20. Although the width of the strut 26 is illustrated as being progressively tapered by way of example, it should be understood that the width of the strut can take on any variation from one lengthwise end to the other lengthwise end. For example, the width of the strut 26 can be constant, progressively taper, or can increase and then decrease at least once along the lengthwise extent of the strut in order to custom contour the support material 20.

The flexible sheet of support material 20 and the strut 26 are preferably made of fabric, but can be made of other practical flexible materials without departing from the scope of the present invention. In sum, contouring is introduced to the support diaphragm 10 through the sewing process and is further achieved when the support material 20 is under tension.

Contouring of the support material 20 provides several benefits as follows:

1) the support diaphragm in its three-dimensional configuration can be designed to conform to the body of the occupant better than a diaphragm stretched flat side to side (or front to back, if oriented in that direction), and 2) the seat requires less foam to distribute load than would otherwise be necessary, or the seat can be made without foam because the support diaphragm can cradle the occupant in the seat without the use of foam.

Figure 2:
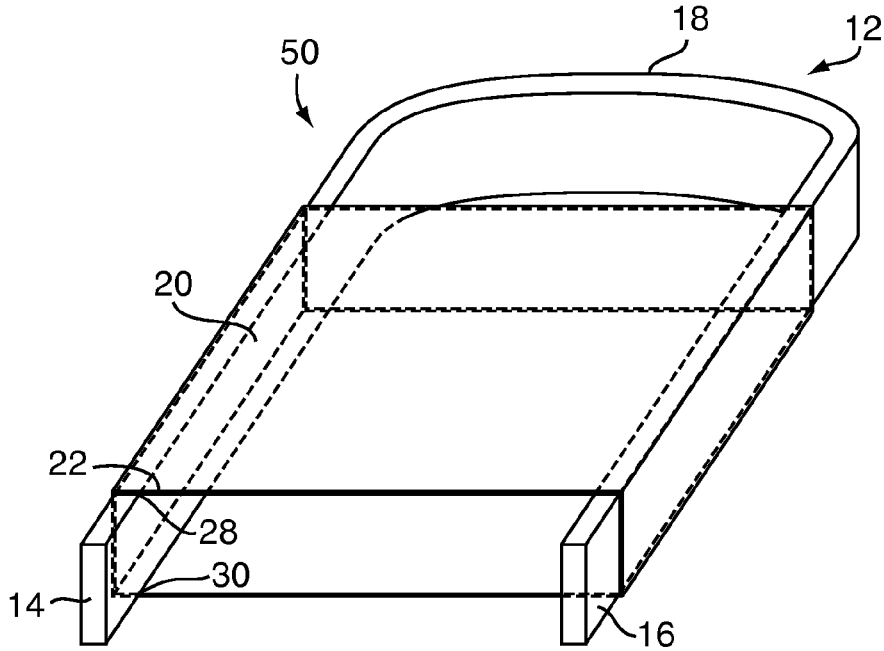
FIG. 2 Prior Art
FIG. 2 is a perspective of a prior art support diaphragm for a chair seat or backrest.

FIG. 2 illustrates a conventional support diaphragm 50 which is similar to the support diaphragm 10 except that the conventional support diaphragm does not include struts. Consequently, the conventional support diaphragm 50 is generally stretched flat and does not provide contouring of the support material 20 for user comfort.

Referring again to FIG. 1, for additional user comfort, the support material 20 forming the front portion 22 can be fabricated from a generally stretchable material to conform to the body shape of the user. Some areas of the support material 20 covering the front portion 22 can be fabricated from a generally non-stretchable material where additional support or firmness may be desirable. As shown in FIG. 1, for example, a lumbar area 31 of the front portion 22 when used as a backrest can be fabricated from a generally non-stretchable material, and a remaining area 32 of the front portion can be fabricated from a generally stretchable material.

The stretchable material is preferably a synthetic fiber which exhibits a 3% to 9% stretch when stretched onto a seat frame under tension. The stretchable material is preferably disposed on front and side surfaces of the support diaphragm used as a backrest, and disposed on top and sides of the support diaphragm used as a seat. Alternatively, the stretchable material can be disposed over the whole diaphragm or other predetermined portions thereof.

Material on the back portion of a support diaphragm used as a backrest, and bottom side of the bottom diaphragm is preferably non-stretchable. For example, the non-stretchable material includes a polyester fabric that has low stretch characteristics. Such non-stretchable material is lighter weight than the stretchable material and thus reduces the overall weight of the diaphragm system. Because it does not stretch, it also pulls the fabric diaphragm to the rear for a backrest, and to the bottom for a bottom cushion more than it would if the stretchable fabric were used.

The support diaphragm may be slid onto a seat frame, or alternatively, zippers may be used for installation of the support diaphragm. Zippers are located on the back side of the backrest support diaphragm or on the bottom side of the bottom or seat support diaphragm. In this instance, the diaphragm is placed around the side supports and the zipper is closed, thereby linking the material around the supporting members and stretching the material by the preferred amount. The zipper is longer than the diaphragm, thus allowing the closure to begin and pull the material together.

Figure 3:
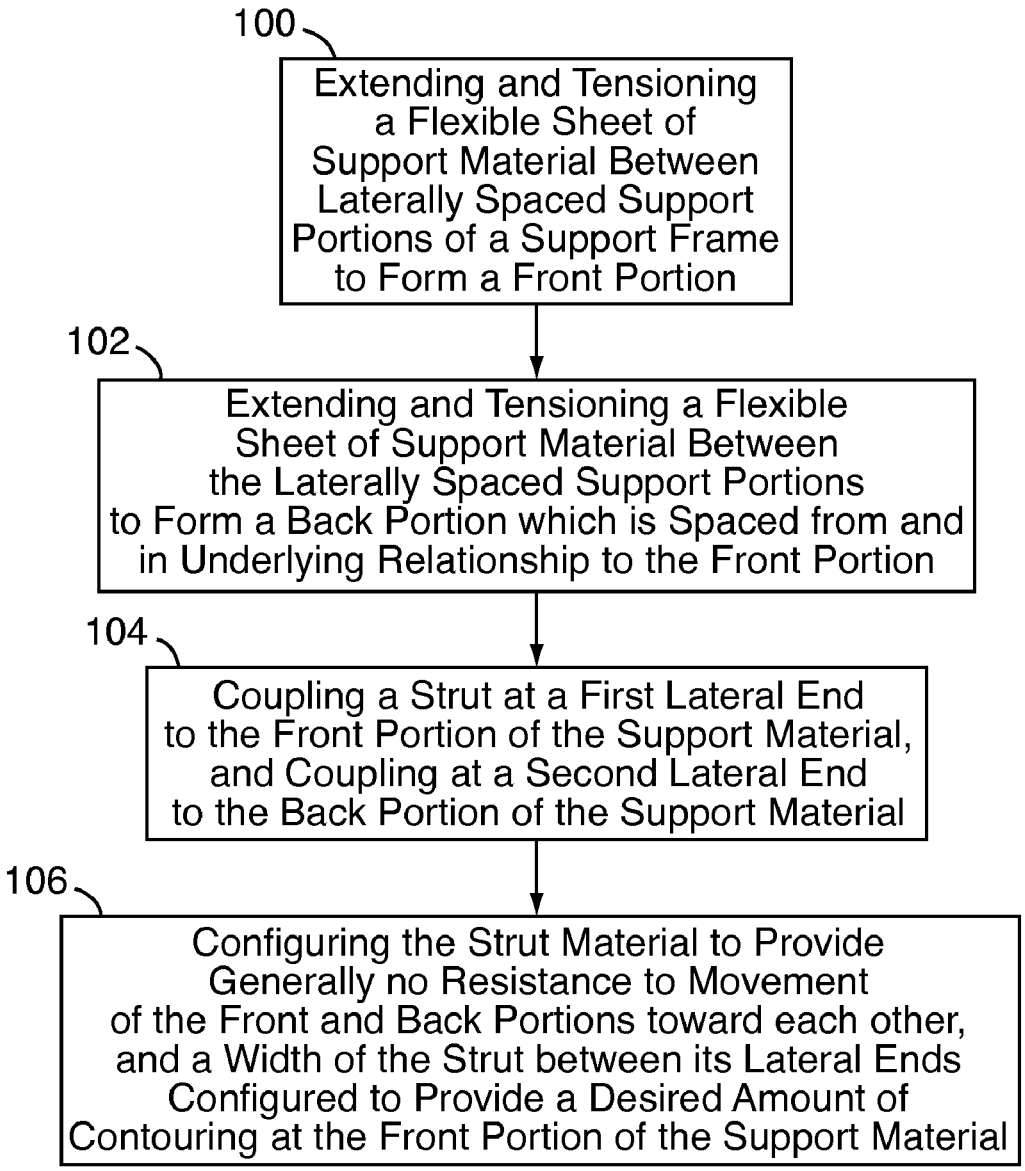
FIG. 3 is a flow diagram illustrating a method of forming a support diaphragm for a chair seat or backrest in accordance with the present invention.

An example of a method of forming a support diaphragm for a chair seat or backrest is illustrated by the flow diagram of FIG. 3. A flexible sheet of support material is extended and generally tensioned between laterally spaced first and second support portions of a support frame to form a front portion (step 100). The flexible sheet of support material is extended to and generally tensioned between the laterally spaced first and second support portions of the support frame to form a back portion spaced from and in underlying relationship to the front portion (step 102). The steps of generally tensioning preferably include generally tensioning the front portion of the support material around at least one of the support portions and extending the support material to the other support portion to form the back portion. A strut is coupled (preferably sewn) at a first lateral end to the front portion of the support material and is coupled (preferably sewn) at a second lateral end to the back portion of the support material such that the strut lengthwise extends along the support material in at least one predetermined direction relative to a direction of tension in the support material (step 104). The strut material is configured to provide generally no resistance to movement of the front portion and the back portion toward each other when pressure is applied to the front portion, and a width of the strut between the first lateral end and the second lateral end is configured to provide a desired amount of contouring of the front portion of the support material (step 106).

As will be recognized by those of ordinary skill in the pertinent art, numerous modifications and substitutions can be made to the above-described embodiments of the present invention without departing from the scope of the invention. Accordingly, the preceding portion of this specification is to be taken in an illustrative, as opposed to a limiting sense.

What is claimed is:

1. A support diaphragm for a backrest of a chair, comprising:

a support frame including laterally spaced first and second support portions;

a support material including a flexible sheet extending from and generally tensioned between the first support portion and the second support portion to form a front portion, and extending from and generally tensioned between the first support portion and the second support portion to form a back portion spaced from and in underlying relationship to the front portion, the front portion being configured as a backrest including a lumbar area fabricated from a generally non-stretchable material and a remaining area of the front portion fabricated from a generally stretchable material; and a strut coupled at a first lateral end to the front portion of the support material and coupled at a second lateral end to the back portion of the support material, the strut lengthwise extending along the support material in at least one predetermined direction relative to a direction of tension in the support material, the strut being configured to provide generally no resistance to movement of the front portion and the back portion toward each other when pressure is applied to the front portion, and a width of the strut between the first lateral end and the second lateral end being configured to provide a desired amount of contouring of the front portion of the support material.

2. A support diaphragm for a seat or backrest of a chair, comprising:

a support frame including laterally spaced first and second support portions;

a support material including a flexible sheet extending from and generally tensioned between the first support portion and the second support portion to form a front portion, and extending from and generally tensioned between the first support portion and the second support portion to form a back portion spaced from and in underlying relationship to the front portion, at least a portion of the front portion being fabricated from a generally stretchable material, and the back portion being fabricated from a generally non-stretchable material; and a strut coupled at a first lateral end to the front portion of the support material and coupled at a second lateral end to the back portion of the support material, the strut lengthwise extending along the support material in at least one predetermined direction relative to a direction of tension in the support material, the strut being configured to provide generally no resistance to movement of the front portion and the back portion toward each other when pressure is applied to the front portion, and a width of the strut between the first lateral end and the second lateral end being configured to provide a desired amount of contouring of the front portion of the support material.

3. A support diaphragm for a seat or backrest of a chair, comprising:

a support frame including laterally spaced first and second support portions;

a support material including a flexible sheet extending from and generally tensioned between the first support portion and the second support portion to form a front portion, and extending from and generally tensioned between the first support portion and the second support portion to form a back portion spaced from and in underlying relationship to the front portion, a portion of the support material being a generally stretchable material and another portion of the support material being a generally non-stretchable material; and a strut coupled at a first lateral end to the front portion of the support material and coupled at a second lateral end to the back portion of the support material, the strut lengthwise extending along the support material in at least one predetermined direction relative to a direction of tension in the support material, the strut being configured to provide generally no resistance to movement of the front portion and the back portion toward each other when pressure is applied to the front portion, and a width of the strut between the first lateral end and the second lateral end being configured to provide a desired amount of contouring of the front portion of the support material.

4. A support diaphragm as defined in claim 3, wherein the non-stretchable material is generally in a lumbar area of a backrest.

* * * * *